US009650226B2

(12) United States Patent
Jacobs

(10) Patent No.: US 9,650,226 B2
(45) Date of Patent: May 16, 2017

(54) SYSTEM AND METHOD FOR CONTROLLING MULTIPLE ELEVATOR CABS IN AN ELEVATOR SHAFT

(71) Applicant: Smart Lifts, LLC, Menlo Park, CA (US)

(72) Inventor: Justin Jacobs, Menlo Park, CA (US)

(73) Assignee: Smart Lifts, LLC, Menlo Park, CA (US)

( * ) Notice: Subject to any disclaimer, the term of this patent is extended or adjusted under 35 U.S.C. 154(b) by 0 days.

(21) Appl. No.: 14/868,293

(22) Filed: Sep. 28, 2015

(65) Prior Publication Data

US 2017/0088393 A1 Mar. 30, 2017

(51) Int. Cl.

| | |
|---|---|
| ***B66B 1/34*** | (2006.01) |
| ***B66B 1/24*** | (2006.01) |
| ***B66B 9/00*** | (2006.01) |

(52) U.S. Cl.

CPC ..... *B66B 1/2433* (2013.01); *B66B 1/24* (2013.01); *B66B 9/00* (2013.01); *B66B 2009/006* (2013.01); *B66B 2201/301* (2013.01)

(58) Field of Classification Search

CPC B66B 1/2433; B66B 1/24; B66B 9/00; B66B 2009/006; B66B 2201/301

USPC ..... 187/247, 249, 380–388, 391, 393, 394

See application file for complete search history.

(56) References Cited

U.S. PATENT DOCUMENTS

| | | | | |
|---|---|---|---|---|
| 5,419,414 | A * | 5/1995 | Sakita | B66B 1/2433 187/247 |
| 5,663,538 | A * | 9/1997 | Sakita | B66B 1/2466 187/249 |
| 5,877,462 | A * | 3/1999 | Chenais | B66B 5/0031 187/249 |
| 6,871,727 | B2 * | 3/2005 | Jokela | B66B 1/18 187/249 |
| 7,360,629 | B2 * | 4/2008 | Hagi | B66B 1/2458 187/249 |
| 7,487,860 | B2 * | 2/2009 | Hikita | B66B 1/2433 187/249 |

(Continued)

OTHER PUBLICATIONS

International Search Report, mailing date of Dec. 2, 2016, for corresponding International Application No. PCT/US2016/054234.

(Continued)

*Primary Examiner* — Anthony Salata

(74) *Attorney, Agent, or Firm* — Intellectual Property Law Group LLP

(57) ABSTRACT

A system and method for controlling multiple elevator cabs in an elevator shaft of a structure, where at least one elevator shaft having a plurality of zones, each zone representing at least one floor of the structure; at least one zone having at least one sensor; at least two elevator cabs moveable within the shaft, each cab moveable independently of other cabs; and a controller that determines movement of each cab into a zone. A first cab preceding any other cab, designated a leading cab; each cab following the leading cab, designated as a trailing cab; each cab moveable in the same direction of travel to service zones until each cab reaches its designated end zone; wherein the controller only instructs a trailing cab to move into a zone with a sensor, after the sensor in the zone detects a cab that was located in such zone has exited that zone thereby preventing collisions.

22 Claims, 5 Drawing Sheets

(56) References Cited

U.S. PATENT DOCUMENTS

| | | | | |
|---|---|---|---|---|
| 7,841,450 | B2 * | 11/2010 | Smith | B66B 1/18 187/249 |
| 7,980,362 | B2 * | 7/2011 | Kostka | B66B 1/3492 187/249 |
| 8,434,599 | B2 * | 5/2013 | Wang | B66B 5/0031 187/249 |
| 8,733,507 | B2 | 5/2014 | Smith et al. | |
| 8,739,936 | B2 * | 6/2014 | Kostka | B66B 1/2433 187/249 |
| 8,813,919 | B2 * | 8/2014 | Silberhorn | B66B 5/0031 187/249 |
| 9,365,392 | B2 * | 6/2016 | Jacobs | B66B 1/2466 |
| 2014/0291074 | A1 * | 10/2014 | Bjorni | B66B 9/00 187/249 |

OTHER PUBLICATIONS

Written Opinion of the International Searching Authority, mailing date of Dec. 2, 2016, for corresponding International Application No. PCT/US2016/054234.

* cited by examiner

SYSTEM AND METHOD FOR CONTROLLING MULTIPLE ELEVATOR CABS IN AN ELEVATOR SHAFT

FIELD OF INVENTION

The invention generally relates to a system and method for controlling the motions and positions of multiple elevator cabs which move independently of each other in an elevator shaft.

BACKGROUND

At the present time there is no safe, simple, efficient and low cost method for controlling the motions and positions of multiple elevator cabs that move independently of each other in the same elevator shaft.

Most current elevator control systems which control multiple cabs in the same shaft, only operate with one elevator cab in each separate region of each elevator shaft, so it is physically impossible for two cabs to collide. Some of these systems express cabs from the ground floor to groups of upper floors and then operate just one cab in each group of floors. All of these systems are very inefficient because each region of each elevator shaft is only being used by one elevator cab. Other high tech control systems propose that multiple cabs can be operated independently of each other in each elevator shaft where sensors attempt to prevent collisions by sensing the speed of each cab and their distances apart, so that a computer can attempt to adjust the speed and distance of each moving cab in the same elevator shaft. However, most of these systems are very complicated, unreliable, expensive and unsafe, because many unexpected things can happen to cause collisions, such as power losses, power fluctuations, data cross feeds, a sensor can fail, there can be an electrical cross circuit, computers can crash, and so forth. A few systems have mechanical collision prevention methods, but they too can fail, and they are clumsy, require slow elevator speeds, and are limited to two elevator cabs.

While it is true that all elevator systems can be exposed to earthquakes, hurricanes, tornadoes, lightning, floods, fires, sabotage, terrorism, low flying airplanes or the like, these possible extraordinary occurrences should not be attributed to an otherwise fail safe computer control system or its method of operation. Accordingly, there is a need for a simple, efficient, low cost and a failsafe computer control system and method thereof which solves all the problems as discussed above.

SUMMARY

Embodiments of the present invention describe a method and system for elevator cabs moving independently of each other in the same elevator shaft to move and operate safely, efficiently, and to keep them from colliding with each other. In an embodiment, the invention employs elevator shaft zones and shaft sections, sensors, video cameras, computers and computer programs to achieve this result. The first moving cab in a group of moving elevator cabs can move in any direction (either up or down) without restriction throughout an elevator shaft, because there is no other elevator cab in front of it that it could collide with. However, a programmed computer must restrict the areas of a shaft that other following cabs can enter, to shaft zones and sections which sensors and cameras indicate are devoid of other cabs. In this manner multiple elevator cabs can move independently of each other through an elevator shaft safely, rapidly and efficiently to service passengers that desire to travel to any destination floor in a structure.

A major purpose of this invention is to describe, explain and demonstrate such a control system using shaft zones and sections, sensors, video cameras, computer programs, and computers to control the motions and positions of multiple elevator cabs moving up or down an elevator shaft in a low-rise, a mid-rise and a high-rise building or structure, in order to prevent such cabs from colliding with each other.

Embodiments of the present invention are as failsafe as any current elevator systems where only one elevator cab can operate in each elevator shaft, because the present inventive method and system prevents an elevator cab from moving to the next possible zone or section of an elevator shaft until after multiple redundant sensors all indicate to an operating computer that such zone or section is completely empty, and devoid of other elevator cabs or any other possible obstructions. At the same time, a benefit of the present invention allows for more than one cab to service a region of an elevator shaft, resulting in better efficiency for passengers and building owners.

According to an embodiment of the present invention, there is an elevator system for controlling two or more elevator cabs in an elevator shaft of a structure, the elevator system comprising: at least one elevator shaft having a plurality of zones, each zone representing at least one floor of a structure; one or more zones of the plurality of zones having at least one sensor; at least two elevator cabs moveable within said at least one elevator shaft and each cab moveable independently of other cabs, wherein a first cab preceding any other cab is designated a leading cab, and each cab following the leading cab is designated a trailing cab; wherein each of the cabs is moveable in a same direction of travel to service zones until each cab has reached its designated end zone. The system further comprising a controller that determines movement of each elevator cab into a zone wherein the controller only instructs a trailing cab to move into a zone with a sensor, hereinafter referred to as the subject zone, after the sensor in said subject zone detects that a cab that was located in such subject zone has exited that subject zone.

According to other embodiments of the present invention, there is a computer-implemented method for controlling multiple elevator cabs in at least one elevator shaft of a structure wherein each cab is moveable independently of the other cabs, the computer comprising a processor, a memory operatively coupled to the processor, the memory storing code executed by the processor for implementing the method; and in another embodiment there is also a computer program product stored on a non-transitory computer readable medium having instructions recorded thereon, that when executed by one or more processors cause the one or more processors to implement a method; wherein the method comprising: detecting a passenger request from a desired zone and in a desired first direction of movement, where a zone represents at least one floor of the structure; directing at least one cab of a set of multiple elevator cabs to begin moving toward the desired zone, all other cabs of the set of multiple elevator cabs are programmed to remain stationary or move in the same first direction of movement as the at least one cab; directing the at least one cab to service passengers to or from the desired zone along the first direction of movement until reaching an end zone; directing at least a second cab of the set of multiple elevator cabs to service passengers to or from a desired zone along the same first direction of movement of the at least one cab until reaching at least a second end zone; and directing at least one cab of the set of multiple cabs to initiate travel in an opposite direction of movement to the first direction, only after each of all of the multiple cabs have reached its designated end zone.

These and other aspects of the present invention are further made apparent, in the remainder of the present document, to those of ordinary skill in the art.

BRIEF DESCRIPTION OF THE DRAWINGS

These and other features, aspects, and advantages of the present invention will become better understood with reference to the following description, appended claims, and accompanying drawings where:

FIGS. 1A, 3, and 4 are simplified in that they do not show the zone sensors, zone video cameras, cab sensors, cab video cameras, and passengers.

FIG. 3 illustrates three elevator shafts (I, II and III) in a 34-floor mid-rise structure with three elevator cabs (T, U and V) positioned on the bottom three floors of Shaft I, with three other elevator cabs (Q, R and S) positioned on the bottom three floors of Shaft II, and with three other elevator cabs (N, O and P) positioned on the bottom three floors of Shaft III, according to an embodiment of the present invention.

FIG. 4 illustrates four elevator shafts (I, II, III, and IV) in a 90-floor high-rise structure with four elevator cabs (J, K, L and M) positioned on the bottom four floors of Shaft I, with four other elevator cabs (F, G, H and I) positioned on the bottom four floors of Shaft II, with four other elevator cabs (B, C, D and E) positioned on the bottom four floors of Shaft III, and with four other elevator cabs (A, Λ, Π, and Ω) positioned on the bottom four floors of Shaft IV, according to an embodiment of the present invention.

DETAILED DESCRIPTION OF THE INVENTION

This invention and elevator computer control system and method can operate in conjunction with any conventional control systems which employ two button lobby calls (up or down), and destination buttons located inside of each cab. It can also operate in conjunction with more sophisticated control systems, such as a destination computer control system where a passenger in a lobby indicates his/her desired destination floor on a ten key pad and a computer indicates which elevator cab in which elevator shaft the passenger should enter to travel to his/her desired destination in the shortest possible time.

In this invention and elevator control system, all sensors and video cameras indicate to the central control system that which they detect. There can be two types of elevator cabs in a group of cabs moving independently up or down in an elevator shaft: leading cabs and trailing cabs. A leading cab is the first cab in a group of elevator cabs that moves and leads the other cabs in any direction, either up or down. All other cabs which follow the leading cab in any direction are designated as trailing cabs. The central computer must restrict the areas of each shaft that a trailing cab can enter, to shaft zones and sections which sensors indicate are devoid of other cabs. On the other hand, leading cabs are not restricted as to the zones or sections that they can enter, because there are no other cabs in front of leading cabs that they could collide with. However, each cab in a shaft can only move in one direction (up or down) from its beginning position to its ending position in that direction through an elevator shaft.

References in the specification to "one embodiment" or to "an embodiment" means that a particular feature, structure, or characteristic described in connection with the embodiments is included in a least one embodiment of the invention. The appearances of the phrase "an embodiment" in various places in the specification are not necessarily all referring to the same embodiment.

In addition, the language used in the specification has been principally selected for readability and instructional purposes, and may not have been selected to delineate or circumscribe the inventive subject matter. Accordingly, the disclosure of the present invention is intended to be illustrative, but not limiting, of the scope of the invention, which is set forth in the claims.

Preferred embodiments of the present invention will now be described and explained with reference to the figures where like reference numbers and letters indicate identical or functionally similar elements.

Figure 1A:
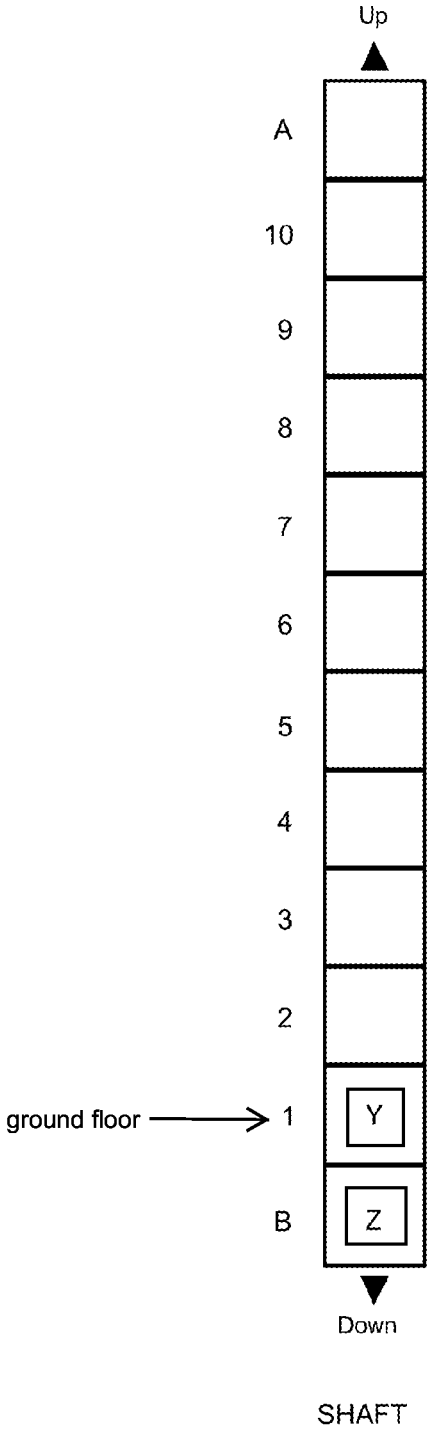
FIG. 1A illustrates an elevator shaft in a 12-floor structure with two elevator cabs (Y and Z) positioned on the bottom two floors of the shaft, according to one embodiment of the present invention.

A view from the front of an embodiment of a multi-cab elevator shaft in a 12-floor structure is illustrated in FIG. 1A. Each floor of the structure can represent a zone in which cabs in the shaft may be positioned. Each zone is designated by a number or a letter located next to each zone. The direction that each elevator cab can move can be indicated by the word 'up' above the shaft, and by the word 'down' below the shaft. At the bottom of the shaft there can be a carpark zone (B), and at the top of the shaft there can be an attic zone (A).

In the bottom two zones of the shaft there can be two elevator cabs respectively designated by the letters Y and Z. Cab Y can be positioned in zone 1 and Cab Z can be positioned in zone B.

Figure 1B:
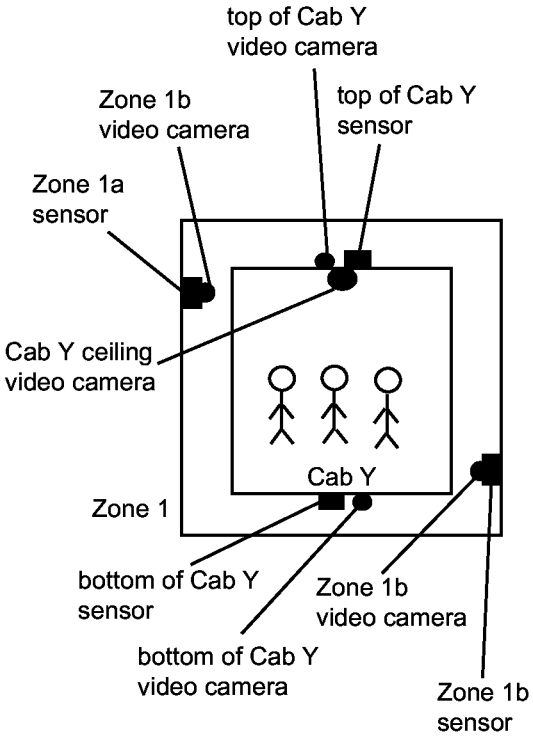
FIG. 1B illustrates an expanded, detailed view of Cab Y positioned in Zone 1 of the shaft, with two zone sensors (Zone 1*a* sensor and Zone 1*b* sensor), two zone video cameras (Zone 1*a* video camera and Zone 1*b* video camera), two cab sensors (top of Cab Y sensor and bottom of Cab Y sensor), two video cameras (top of Cab Y video camera and the bottom of Cab Y video camera), a ceiling video camera (Cab Y ceiling video camera), and passengers, according to one embodiment of the present invention.

An expanded, detailed view of Cab Y positioned in Zone 1 of the shaft is illustrated in FIG. 1B. There can be one or more electronic sensors located in each zone. Electronic sensors located on the top and bottom of each cab can detect the distance between cabs and the speed of closure or separation between cabs. If the distance between cabs becomes too close for the speed of closure, a computer and/or an elevator governor can apply brakes to slow a cab down to a safe speed or distance. Each sensor can be connected to a central computer which can be programmed to control all of the motions and functions of each elevator cab in a structure. Sensors can also be mechanical sensors or other types of sensors, such as laser sensors.

Each cab can have one or more video cameras/devices or other visual indicators, located on the top and on the bottom of the cab, or elsewhere on the cab. Each video camera can be focused on the shaft in each direction of the cab's motion through the shaft. Each sensor can have a video camera focused on an illuminated zone of the shaft. All sensors and video cameras can be connected to computer screens in the central operations room of the elevator system. Each cab can also have a video camera mounted on the inside center of the cab's ceiling which can scan the inside of the cab.

If there is a failure or other problem with any cab, with any sensor, with any camera, with any part of the shaft, with any other element of the system, or a conflict between any sensor or any camera, one or more alarms can be programmed to sound in the central operations room, and a human attendant can be instructed to immediately see what, if anything, is happening. The motions and functions of any cab can be manually controlled by a human attendant.

The number, location and/or description of the shaft, floors, zones, sequential steps, elevator cabs, computers, computer programs, cameras and any other element of the invention can vary, as desired by the system operator.

When a sensor is referred to in any zone, as described in the specification, this means and includes: 1) all sensors that are positioned in such zone; 2) that each sensor independently detects that such zone is empty; and 3) that each sensor is fully operational.

Examples of the motions and changed positions of each cab in the elevator shaft of the structure will hereafter be described in sequential steps, in order to demonstrate and explain the control system and method, according to an embodiment of the present invention.

Step 1. Trailing Cab Z can load carpark passengers in zone B of FIG. 1. Leading Cab Y can load passengers in zone 1 of the structure. Cab Y can then move up the shaft and service passengers in the shaft.

Step 2. After a sensor in zone 1 indicates that leading Cab Y has exited zone 1, trailing Cab Z can move up into zone 1 and load passengers.

Step 3. Leading Cab Y can continue servicing passengers in the shaft. After a sensor in zone 5 indicates that leading Cab Y has exited zone 5, trailing Cab Z can move up out of zone 1 and service other passengers in all zones below zone 6.

Step 4. When leading Cab Y moves into zone 10 all remaining passengers in Cab Y can be unloaded on Floor 10. Leading Cab Y can then move up into the attic zone A and stop.

Step 5. After a sensor in zone 10 indicates that leading Cab Y has exited zone 10, trailing Cab Z can move up into zone 6 and service passengers in all zones below zone A.

Step 6. When trailing Cab Z moves into zone 10, Cab Z can unload all remaining up passengers, and then load down passengers.

Step 7. Cab Z (the new leading cab) can then exit zone 10 and move down the shaft to service passengers in the shaft.

Step 8. After a sensor in zone 10 indicates that leading Cab Z has exited zone 10, new trailing Cab Y can move down out of zone A and into zone 10 and load down passengers.

Step 9. Leading Cab Z can continue servicing passengers in the shaft. After a sensor in zone 6 indicates that Cab Z has exited zone 6, trailing Cab Y can move out of zone 10 and service passengers above zone 5.

Step 10. After leading Cab Z enters zone 1, Cab Z can unload passengers on zone 1. Cab Z can then move down into carpark zone B, unload passengers and stop.

Step 11. After sensors in zone 1 indicate that leading Cab Z had exited zone 1, trailing Cab Y can move down into zone 5 and service passengers above zone B.

Step 12. When trailing Cab Y enters zone 1, Cab Y can stop. Then all remaining passengers in Cab Y can unload and exit the structure.

Figure 2:
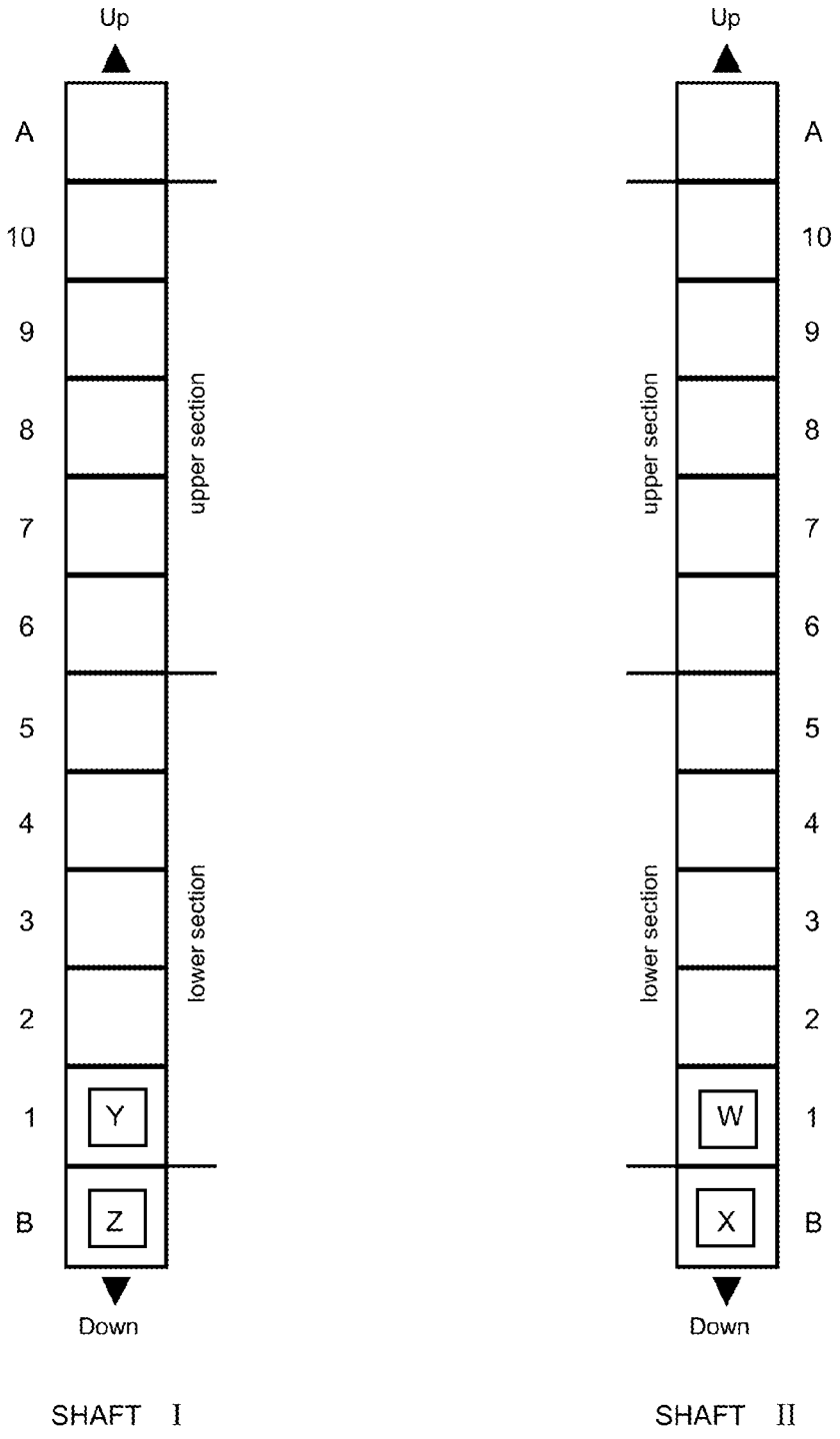
FIG. 2 illustrates two elevator shafts (I and II) in a 12-floor low-rise structure with two elevator cabs (Y and Z) positioned on the bottom two floors of Shaft I and with two other elevator cabs (W and X) positioned on the bottom two floors of Shaft II, according to an embodiment of the present invention.

Once a cycle of sequential steps is completed, this process can be continuously repeated all over again, until it is terminated by a computer or by a human attendant. As demonstrated by the above steps, each of the cabs in the shaft is moveable in the same direction of travel to service zones until each cab has reached its designated end zone. After all cabs in a shaft have completed reaching their designated end zones, travel can be initiated in an opposite direction of travel than the direction just completed. As illustrated by the sequence of steps of the above described embodiment, the controller of the system only instructs a trailing cab to move into a desired zone with a sensor, after the sensor detects and indicates to said computer that a cab that was located in such desired zone has exited that desired zone. A view from the front of an embodiment of two multi-cab elevator shafts (I and II) in a 12-floor low-rise structure is illustrated in FIG. 2. Each floor of each shaft can represent a zone in which cabs in that shaft may be positioned. Each zone in each shaft is designated by a number or a letter located next to each zone. Each shaft can be divided into two or more sections: a lower section and an upper section. Each section represents a plurality of zones. The direction that each elevator cab can move in each shaft can be indicated by the word 'up' above each shaft, and by the word 'down' below each shaft. At the bottom of each shaft there can be a carpark zone (B), and at the top of each shaft there can be an attic zone (A).

In the bottom two zones of Shaft I there can be two elevator cabs respectively designated by the letters Y and Z. Cab Y can be positioned in zone 1 and Cab Z can be positioned in zone B. In the bottom two zones of Shaft II there can be two other elevator cabs respectively designated by the letters W and X. Cab W can be positioned in zone I and Cab X can be positioned in zone B.

There can be one or more electronic sensors located in each zone of each shaft. Each sensor must indicate that no cab is in such zone before a trailing cab may enter and operate in such zone. Electronic sensors on the top and bottom of each cab can detect the distance between cabs and the speed of closure or separation between cabs. If the distance between cabs becomes too close for the speed of closure, a computer and/or an elevator governor can apply brakes to slow a cab down to a safe speed or distance. Each sensor can be connected to a central computer which can be programmed to control all of the motions and functions of each elevator cab in a low-rise structure. Sensors can also be mechanical sensors or other types of sensors, such as laser sensors. It is noted that the sensors on each end of each cab may serve as another layer of safety in case all zone and section sensors fail, making sure that no other obstruction (i.e. a man or an animal or object) is between the cab and the next zone, and to slow a cab down if necessary.

Each cab can have one or more video cameras or other visual indicators, located on the top and on the bottom of the cab, or elsewhere on the cab. Each video camera can be focused on the shaft in each direction of the cab's motion through the shaft. Each sensor can have a video camera focused on an illuminated zone or section of a shaft. Each video camera may be equipped with a corresponding illuminator as well. All sensors and video cameras can be connected to computer screens in the central operations room of the elevator system. Each cab can also have a video camera mounted on the inside center of the cab's ceiling which can scan the inside of the cab.

If there is a failure or other problem with any cab, with any sensor, with any camera, with any part of any shaft, with any other element of the system, or a conflict between any sensor or any camera, one or more alarms can be programmed to sound, in the central operations room, and a human attendant can be instructed to immediately see what, if anything, is happening. The motions and functions of any cab can be manually controlled by a human attendant.

The number, location and/or description of shafts, floors, zones, sections, sequential steps, elevator cabs, computers, computer programs, cameras and any other element of the invention can vary, as desired by the system operator.

When sensors are referred to in any zone of any shaft, as described in the specification, this means and includes: 1) that all sensors that are positioned in such zone; 2) that each sensor independently detects that such zone is empty; and 3) that each sensor is fully operational.

Examples of the motions and changed positions of each cab in each elevator shaft of a low-rise structure will hereafter be described in sequential steps, in order to demonstrate and explain the control system and method, according to an embodiment of the present invention.

Step 1. Trailing Cab Z can load carpark passengers in zone B of Shaft I. Leading Cab Y can load passengers in zone 1 on the ground floor of a low-rise structure. Cab Y can then move up Shaft I and service passengers in the lower section of Shaft I.

Step 2. After sensors in zone 1 indicate that leading Cab Y has exited the ground floor zone 1, trailing Cab Z can move up into zone 1 and load passengers.

Step 3. Leading Cab Y can then move up into zone 6 and service passengers in the upper section of Shaft I. After sensors in zone 5 indicate that leading Cab Y has exited zone 5, trailing Cab Z can move up out of zone 1 and service other passengers in the lower section of Shaft I.

Step 4. When leading Cab Y moves into zone 10 all remaining passengers in Cab Y can be unloaded on Floor 10. Leading Cab Y can then move up into the attic zone A and stop.

Step 5. After sensors in zone 10 indicate that leading Cab Y has exited zone 10, trailing Cab Z can move up into zone 6 and service passengers in the upper section of Shaft I.

Step 6. When trailing Cab Z moves into zone 10, Cab Z can unload all remaining up passengers, and then load down passengers.

Step 7. At this approximate point in time, Cabs W and X in Shaft II of a low-rise structure can begin to execute the aforementioned steps 1 through 6 in Shaft II.

Step 8. Cab Z (the new leading cab) can then exit zone 10 and move down Shaft I to service passengers in the upper section of Shaft 1.

Step 9. After sensors in zone 10 indicate that leading Cab Z has exited zone 10, new trailing Cab Y can move down out of zone A and into zone 10 and load down passengers.

Step 10. Leading Cab Z can then move down into zone 5 and service passengers in the lower section of Shaft 1. After leading Cab Z enters zone 1, Cab Z can unload passengers on the ground floor of a low-rise structure and then move down into carpark zone B and unload and load passengers.

Step 11. After sensors in zone 6 indicate that leading Cab Z has exited zone 6, trailing Cab Y can move down into zone 9 and service passengers in the upper section of Shaft I.

Step 12. After sensors in zone 1 indicate that leading Cab Z has exited zone 1, trailing Cab Y can move down into zone 5 and service passengers in the lower section of Shaft 1.

Step 13. After trailing Cab Y enters zone 1, Cab Y can stop. Then all remaining passengers in Cab Y can unload and exit the low-rise structure.

Step 14. At this approximate point in time, Cabs W and X in Shaft II of a low-rise structure can begin to execute the aforementioned sequential steps 8 through 13 in Shaft II, while Cab Y and Cab Z can begin to execute their previously mentioned sequential steps 1 through 6 again in Shaft I.

Once a cycle of sequential steps is completed, this process can be continuously repeated all over again, until it is terminated by a computer or by a human attendant.

Thus, when elevator cabs in Shaft I and Shaft II in a low-rise structure operate together in sequence, their traffic pattern can become circular. This means that there can always be elevator cabs moving up in a shaft in sequence in the low-rise structure while other elevator cabs in the other shaft are moving down in sequence. Therefore, no passenger in a low-rise structure must wait very long to be serviced by an elevator cab moving up or down.

Figure 3:
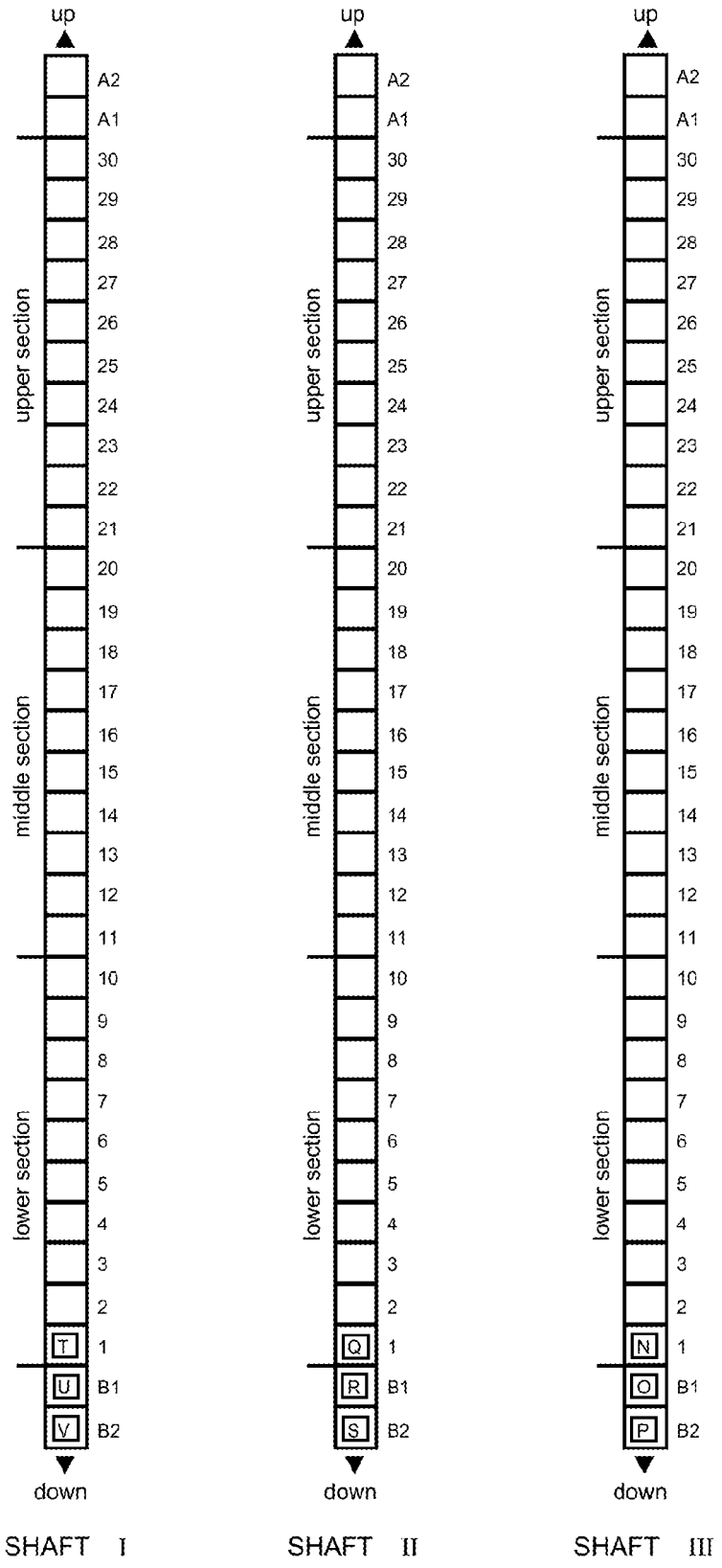

A view from the front of an embodiment of three multi-cab elevator shafts (I, II and III) in a 34-floor mid-rise structure is illustrated in FIG. 3. Each Shaft can be divided into three sections: a lower section, a middle section, and an upper section. Each floor of each shaft can represent a zone in which cabs in that shaft may be positioned. Each zone in each shaft can be designated by a number and/or a letter located next to each zone. The direction that each cab can move in each shaft can be indicated by the word 'up' above each shaft, and by the word 'down' below each shaft. At the bottom of each shaft there can be two carpark zones (B1 and B2), and at the top of each shaft there can be two attic zones (A1 and A2).

In the bottom three zones of Shaft I there can be three elevator cabs respectively designated by the letters V, U and T. Cab V can be positioned in zone B2, Cab U can be positioned in zone B1, and Cab T can be positioned in zone 1. In the bottom three zones of Shaft II there can be three other elevator cabs respectively designated by the letters S, R and Q. Cab S can be positioned in zone B2, Cab R can be positioned in zone B1, and Cab Q can be positioned in zone 1. In the bottom three zones of Shaft III there can be three other elevator cabs respectively designated by the letters P, O and N. Cab P can be positioned in zone B2, Cab O can be positioned in zone B1, and Cab N can be positioned in zone 1.

There can be one or more electronic sensors located in each zone of each shaft. Electronic sensors on the top and bottom of each cab can detect the distance between cabs and the speed of closure or separation between cabs. If the distance between cabs becomes too close for the speed of closure, a computer and/or an elevator governor can apply brakes to slow a cab down to a safe speed or distance. Each sensor can be connected to a central computer which can be programmed to control all of the motions and functions of each elevator cab in a mid-rise structure. Sensors can also be mechanical sensors or other types of sensors, such as laser sensors.

Each cab can have a video camera located on the top and on the bottom of the cab. Each video camera can be focused on the shaft in each direction of the cab's motion through the shaft. Each sensor can have a video camera focused on the zone of its responsibility. All sensors and video cameras can be connected to computer screens in the central operations room of the elevator system. Each cab can also have a video camera mounted on the inside center of the cab's ceiling, which camera can scan the inside of the cab.

If there is a failure or other problem with any cab, with any sensor, with any camera, with any part of any shaft, with any other element of the system, or a conflict between any sensor or any camera, one or more alarms can be programmed to sound, and a human attendant can be instructed to immediately see what (if anything) is happening. The motions and functions of any cab can be manually controlled by a human attendant.

The number, location and/or description of shafts, floors, zones, sections, sequential steps, elevator cabs, computers, computer programs, cameras and any other element of the invention can vary, as desired by the system operator.

When sensors are referred to in any zone of any shaft, as described in the specification, this means and includes: 1) that all sensors are positioned in such zone; 2) that each sensor independently detects that such zone is empty; and 3) that each sensor is fully operational.

Examples of the motions and changed positions of each cab in each shaft of a mid-rise structure will hereafter be described in sequential steps, in order to demonstrate and explain the control method and system, according to an embodiment of the present invention.

Step 1. Cab V can load lower carpark passengers in zone B2. Cab U can load upper carpark passengers in zone B1. Cab T can load ground floor passengers in zone 1. Cab T (the leading cab) can move up Shaft I to service passengers in the lower section of Shaft I.

Step 2. After sensors in zone I indicate that leading Cab T has exited zone 1, trailing Cab U can move up into zone 1 and load ground floor passengers. After sensors in zone B1 indicate that Cab U has exited zone B1, trailing Cab V can move up into zone B1 and continue loading carpark passengers.

Step 3. After sensors in zone 10 indicate that leading Cab T has exited zone 10, trailing Cab U can move up Shaft I and service passengers in the lower section of Shaft I. After sensors in zone 1 indicate that Cab U has exited zone 1, trailing Cab V can move up into zone 1 and load ground floor passengers.

Step 4. After sensors in zone 20 indicate that leading Cab T has exited zone 20, trailing Cab U can move up into zone 11 and service passengers in the middle section of Shaft I. After sensors in zone 10 indicate that trailing Cab U has exited zone 10, trailing Cab V can move up Shaft I and service passengers in the lower section of Shaft I.

Step 5. When leading Cab T enters zone 30, Cab T can unload all remaining passengers and then move directly up Shaft I into zone A2 where it can stop.

Step 6. After sensors in zone A1 indicate that Cab T has exited zone A1, Cab U can move up into zone 21 and service passengers in the upper section of Shaft I. After Cab U enters zone 30, Cab U can unload all remaining passengers on Floor 30 and move up into zone A1 where it can stop.

Step 7. At this approximate point in time, Cabs Q, R and S in Shaft II can begin to execute the aforementioned steps 1 through 6 in Shaft II.

Step 8. After sensors in zone 20 of Shaft I indicate that Cab U has exited zone 20, trailing Cab V can move up Shaft 1 into zone 11 and service passengers in the middle section of Shaft I. After sensors in zone 30 indicate that Cab U has exited zone 30, trailing Cab V can move up into zone 21 and service passengers in the upper section of Shaft I. When trailing Cab V enters zone 30 it can unload all remaining passengers and stop.

Step 9. After Cab V (the new leading cab) loads new down passengers on Floor 30, Cab V can enter zone 29 and service passengers in the upper section of Shaft I. After leading Cab V exits zone 21, Cab V can continue to move down Shaft I and service passengers in the middle section of Shaft I.

Step 10. After sensors in zone 30 indicate that leading Cab V has exited zone 30, trailing Cab U can move down Shaft 1 and enter zone 30 where it can load down passengers. After sensors in zone A1 indicate that Cab U has exited zone A1, new trailing Cab T can move down into zone A1 and wait.

Step 11. After sensors in zone 21 indicate that leading Cab V has exited zone 21, trailing Cab U can move down Shaft I and service passengers in the upper section of Shaft I. After sensors in zone 30 indicate that Cab U has exited zone 30, trailing Cab T can move down into zone 30 and load down passengers.

Step 12. At this approximate point in time, Cabs N, O and P in Shaft III can begin to execute the aforementioned steps 1 through 6 in Shaft III, and Cabs Q, R and S in Shaft II can begin to execute the aforementioned steps 8 through 11 in Shaft II.

Step 13. After sensors in zone 11 of Shaft I indicate that leading Cab V has exited zone 11, trailing Cab U can move down Shaft I into zone 20 and service passengers in the middle section of Shaft I. After sensors in zone 21 indicate that Cab U has exited zone 21, trailing Cab T can move down Shaft I into zone 29 and service passengers in the upper section of Shaft I.

Step 14. After leading Cab V moves into zone 10, Cab V can continue to move down Shaft I and service passengers in the lower section of Shaft I. After Cab V exits zone 1 it can move down Shaft I to lower carpark zone B2 where it can stop and load and unload passengers.

Step 15. After sensors in zone 1 of Shaft I indicate that leading Cab V has exited zone 1, trailing Cab U can move down into zone 10 and service passengers in the lower section of Shaft I. After sensors in zone 11 indicate that Cab U has exited zone 11, trailing Cab T can move down Shaft I into zone 20 and service passengers in the middle section of Shaft I.

Step 16. After sensors in zone B1 indicate that Cab V has exited zone B1, Cab U can move down Shaft I into upper carpark zone B1 where it can stop and load and unload passengers. After sensors in zone 1 indicate that Cab U has exited zone 1, trailing Cab T can move down into zone 10 and service passengers in the lower section of Shaft I. When Cab T stops in zone 1, Cab T can unload all remaining passengers and wait to load new up passengers.

Step 17. At this approximate point in time, elevator Cabs Q, R and S in Shaft II, and elevator Cabs N, O and P in Shaft III, can continue to execute their remaining previously mentioned sequential steps in Shaft II and Shaft III respectively, while Cabs T, U and V in Shaft I can begin to execute their previously mentioned sequential steps 1 through 6 again. Once a cycle of sequential steps is completed in a mid-rise structure, this process can be continuously repeated all over again, until it is terminated by a computer or by a human attendant.

When elevator cabs in Shaft I, Shaft II, and Shaft III in a mid-rise structure all operate together in sequence, their traffic pattern can become circular. Thus, there are always elevator cabs moving up in a shaft in sequence when other elevator cabs in other shafts are moving down in sequence. Therefore, no passenger in a mid-rise structure must wait very long to be serviced by an elevator cab moving up or down in sequence.

Figure 4:
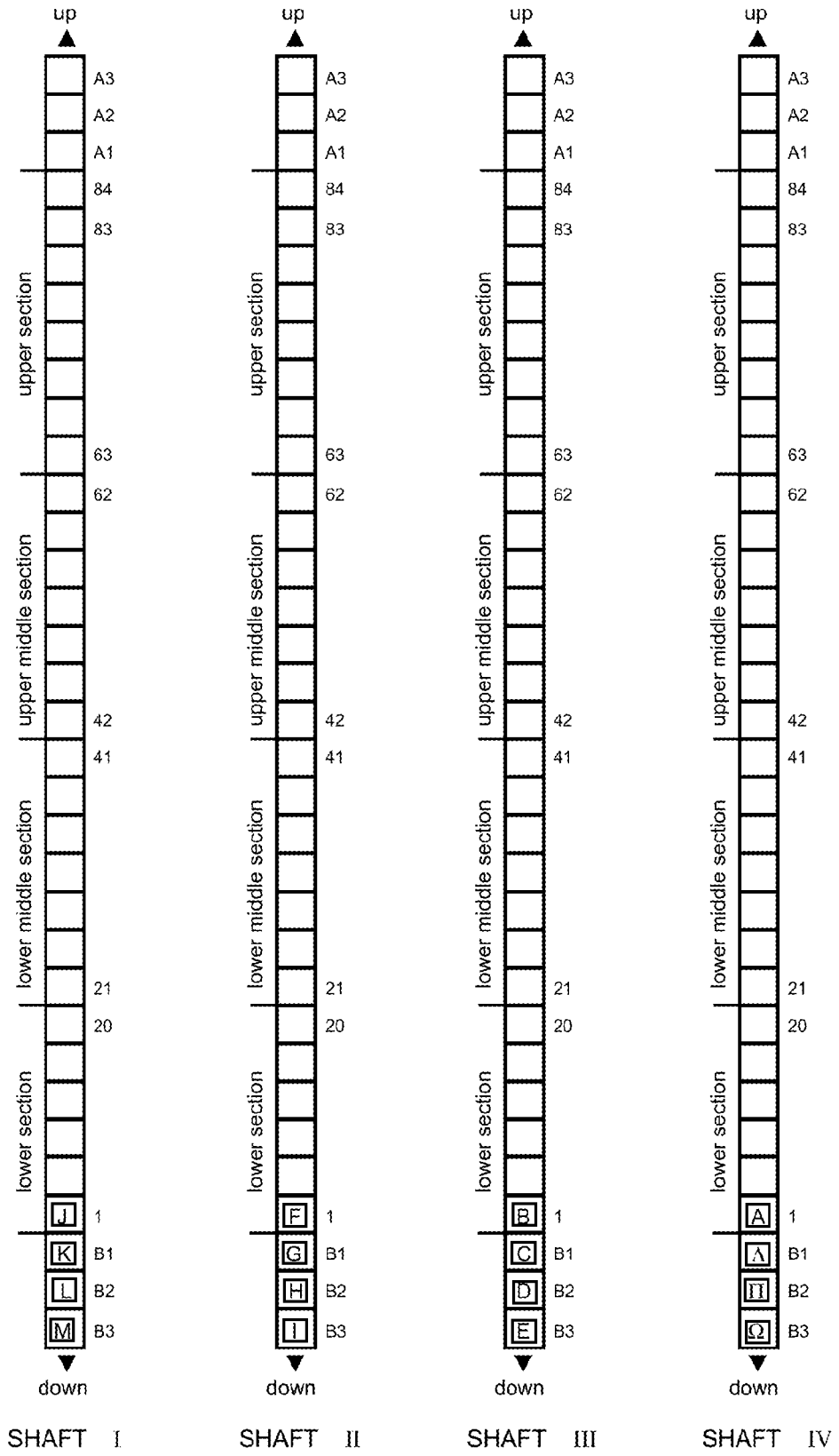

A view from the front of an embodiment of four multi-cab elevator shafts (I, II, III and IV) in a 90-floor high-rise structure is illustrated in FIG. 4. Each Shaft can be divided into four sections: a lower section, a lower middle section, an upper middle section, and an upper section. Each floor of each shaft can represent a zone in which cabs in that shaft may be positioned. Each zone in each shaft can be designated by a number and/or a letter located next to each zone. The direction that each cab can move in each shaft can be indicated by the word 'up' above each shaft, and by the word 'down' below each shaft. At the bottom of each shaft there can be three carpark zones (B1, B2, and B3), and at the top of each shaft there can be three attic zones (A1, A2, and A3).

In the bottom four zones of Shaft I there can be four elevator cabs respectively designated by the letters J, K, L and M. Cab M can be positioned in zone B3, Cab L can be positioned in zone B2, Cab K can be positioned in zone B1, and Cab J can be positioned in zone 1. In the bottom four zones of Shaft II there can be four other elevator cabs respectively designated by the letters F, G, H, and I. Cab I can be positioned in zone B3, Cab H can be positioned in zone B2, Cab G can be positioned in zone B1, and Cab F can be positioned in zone 1. In the bottom four zones of Shaft III there can be four other elevator cabs respectively designated by the letters B, C, D, and E. Cab E can be positioned in zone B3, Cab D can be positioned in zone B2, Cab C can be positioned in zone B1, and Cab B can be positioned in zone 1. In the bottom four zones of Shaft IV there can be four other elevator cabs respectively designated by the letters A, Λ, Π, and Ω (the last three are letters in the Greek alphabet). Cab Ω can be positioned in zone B3, Cab Π can be positioned in zone B2, Cab Λ can be positioned in zone B1, and Cab A can be positioned in zone 1.

There can be one or more electronic sensors located in each zone of each shaft. Electronic sensors on the top and bottom of each cab can detect the distance between cabs and the speed of closure or separation between cabs. If the distance between cabs becomes too close for the speed of closure, a computer and/or an elevator governor can apply brakes to slow a cab down to a safe speed or distance. Each sensor can be connected to a central computer which can be programmed to control all of the motions and functions of each elevator cab in a high-rise structure. Sensors can also be mechanical sensors or other types of sensors, such as laser sensors.

Each cab can have a video camera located on the top and on the bottom of the cab. Each video camera can be focused on the shaft in each direction of the cab's motion through the shaft. Each sensor can have a video camera focused on the zone of its responsibility. All sensors and video cameras can be connected to computer screens in the central operations room of the elevator system. Each cab can also have a video camera mounted on the inside center of the cab's ceiling which video camera can scan the inside of the cab.

If there is a failure or other problem with any cab, with any sensor, with any camera, with any part of any shaft, with any other element of the system, or a conflict between any sensor or any camera, one or more alarms can be programmed to sound, and a human attendant can be instructed to immediately see what (if anything) is happening. The motions and functions of any cab can be manually controlled by a human attendant.

The number, location and/or description of shafts, floors, zones, sections, sequential steps, elevator cabs, computers, computer programs, cameras and any other element of the invention can vary, as desired by the system operator.

When sensors are referred to in any zone of any shaft, as described in the specification, this means and includes: 1) that all sensors are positioned in such zone; 2) that each sensor independently detects that such zone is empty; and 3) that each sensor is fully operational.

Examples of the motions and changed positions of each cab in each shaft of a high-rise structure will hereafter be described in sequential steps, in order to demonstrate and explain the control method and system, according to an embodiment of the present invention.

Step 1. In Shaft I, Cab M can load carpark passengers in zone B3; Cab L can load carpark passengers in zone B2; Cab K can load carpark passengers in zone B1; Cab J can load passengers on the ground floor of a high-rise structure in zone 1.

Step 2. Cab J (the leading cab) can then move up Shaft I and service passengers in the lower section of Shaft I. After sensors in zone 1 indicate that Cab J has exited zone 1, trailing Cab K can move up Shaft I into zone 1 and load ground floor passengers. After sensors in zone B1 indicate that Cab K has exited zone B1, trailing Cab L can move up Shaft I into zone B1 and continue loading carpark passengers. After sensors in zone B2 indicate that Cab L has exited zone B2, trailing Cab M can move up Shaft I into zone B2 and continue loading carpark passengers.

Step 3. When leading Cab J exits zone 20, Cab J can move up into zone 21 and service passengers in the lower middle section of Shaft I. After sensors in zone 20 indicate that leading Cab J has exited zone 20, trailing Cab K can move up into zone 1 and load ground floor passengers. Cab K can then move up Shaft I to service passengers in the lower section of Shaft I. After sensors in zone B1 indicate that Cab K has exited zone B1, trailing Cab L can move up into zone B1 and continue loading carpark passengers. After sensors in zone B2 indicate that Cab L has exited zone B2, trailing Cab M can move up into zone B2 and continue loading carpark passengers.

Step 4. When leading Cab J exits zone 41, Cab J can move up into zone 42 and service passengers in the upper middle section of Shaft 1. After sensors in zone 41 indicate that Cab J has exited zone 41, trailing Cab K can move up into zone 21 and service passengers in the lower middle section of Shaft 1. After sensors in zone 1 indicate that Cab L has exited zone 1, trailing Cab M can move up into zone 1 and load ground floor passengers.

Step 5. At this approximate point in time, Cabs F, G, H and I in Shaft II of a high-rise structure can begin to execute the aforementioned steps 1 through 4 in Shaft II of a high-rise structure.

Step 6. When leading Cab J exits zone 62, Cab J can move up into zone 63 and service passengers in the upper section of Shaft I. After sensors in zone 62 indicate that Cab J has exited zone 62, trailing Cab K can move up into zone 42 and service passengers in the upper middle section of Shaft I. After sensors in zone 41 indicate that Cab K has exited zone 41, trailing Cab L can move up into zone 21 and service passengers in the lower middle section of Shaft I. After sensors in zone 20 indicate that Cab L has exited zone 20, trailing Cab M can move up from zone 1 and service passengers in the lower section of Shaft I.

Step 7. When leading Cab J enters zone 84, Cab J can unload all remaining passengers and then move directly up into zone A3 where it can stop. After sensors in zone 84 indicate that Cab J has exited zone 84, trailing Cab K can move up into zone 63 and service passengers in the upper section of Shaft I. When Cab K enters zone 84 Cab K can unload all remaining passengers and then move directly up into zone A2 where it can stop.

Step 8. After sensors in zone 84 indicate that Cab K has exited zone 84, trailing Cab L can move up into zone 63 and service passengers in the upper section of Shaft I. When Cab L enters zone 84 Cab L can unload all remaining passengers. After sensors in zone A1 indicate that Cab K has exited zone A1, trailing Cab L can move directly up into zone A1 where it can stop.

Step 9. After sensors in zone 41 indicate that Cab L has exited zone 41, trailing Cab M can move up into zone 21 and service passengers in the lower middle section of Shaft I. After sensors in zone 62 indicate that Cab L has exited zone 62, trailing Cab M can move up into zone 42 and service passengers in the upper middle section of Shaft I. After sensors in zone 84 indicate that Cab L has exited zone 84, trailing Cab M can move up into zone 63 and service passengers in the upper section of Shaft I. When Cab M moves into zone 84, Cab M can unload all remaining passengers and load new passengers who desire to move down Shaft I.

Step 10. At this approximate point in time, Cabs B, C, D and E in Shaft III can begin to execute the aforementioned steps 1 through 4 in Shaft III of a high-rise structure, and Cabs F, G, H and I in Shaft II can begin to execute the aforementioned steps 6 through 9 in Shaft II of a high-rise structure.

Step 11. When Cab M (the new leading cab in Shaft I) exits zone 84, it can move down Shaft I and service passengers in the upper section of Shaft I. After sensors in zone 84 indicate that leading Cab M has exited zone 84, new trailing Cab L can move down into zone 84 and load down passengers. After sensors in zone A1 indicate that Cab L has exited zone A1, new trailing Cab K can move down into zone A1 and wait. After sensors in zone A2 indicate that trailing Cab K has exited zone A2, new trailing Cab J can move down into zone A2 and wait.

Step 12. When leading Cab M exits zone 63, Cab M can continue moving down Shaft I and service passengers in the upper middle section of Shaft I. After sensors in zone 63 indicate that Cab M has exited zone 63, trailing Cab L can move down into zone 84 and service passengers in the upper section of Shaft I. After sensors in zone 84 indicate that Cab L has exited zone 84, new trailing Cab K can move down into zone 84 and load down passengers. After sensors in zone A1 indicate that trailing Cab K has exited zone A1, new trailing Cab J can move down into zone A1 and wait.

Step 13. When leading Cab M exits zone 42, Cab M can continue moving down Shaft I and service passengers in the lower middle section of Shaft I. After sensors in zone 42 indicate that Cab M has exited zone 42, trailing Cab L can move down into zone 62 and service passengers in the upper middle section of Shaft I. After sensors in zone 63 indicate that Cab L has exited zone 63, trailing Cab K can move down into zone 83 and service passengers in the upper section of Shaft I. After sensors in zone 84 indicate that Cab K has exited zone 84, trailing Cab J can move down into zone 84 and load down passengers.

Step 14. When leading Cab M exits zone 21, Cab M can continue down Shaft I and service passengers in the lower section of Shaft I. After sensors in zone 21 indicate that Cab M has exited zone 21, trailing Cab L can move down into zone 41 and service passengers in the lower middle section of Shaft I. After sensors indicate that Cab L has exited zone 42, trailing Cab K can move down into zone 62 and service passengers in the upper middle section of Shaft I. After sensors indicate that Cab K has exited zone 63, trailing Cab J can move out of zone 84 and service passengers in the upper section of Shaft I.

Step 15. At this approximate point in time, Cabs A, Λ, Π, and Ω in Shaft IV can begin to execute the aforementioned steps 1 through 4 in Shaft IV of a high-rise structure; Cabs B, C, D and E in Shaft III can begin to execute the aforementioned steps 6 through 9 in Shaft III of a high-rise structure; and cabs F, G, H and I in Shaft II can begin to execute the aforementioned steps 11 through 14 in Shaft II of a high-rise structure.

Step 16. When leading Cab M enters zone 1 of Shaft I, Cab M can unload passengers on the ground floor of a high-rise structure. Cab M can then move down into carpark zone B1 and unload more passengers. After sensors in zone 1 indicate that leading Cab M has exited zone 1, trailing Cab L can move down into zone 20 and service passengers in the lower section of Shaft 1. When trailing Cab L enters zone 1, Cab L can stop and unload passengers on the ground floor. After sensors in zone 21 indicate that Cab L has exited zone 21, trailing Cab K can move down into zone 41 and service passengers in the lower middle section of Shaft I. After sensors in zone 42 indicate that Cab K has exited zone 42, trailing Cab J can move down into zone 62 and service passengers in the upper middle section of Shaft I.

Step 17. When leading Cab M finishes unloading passengers in carpark zone B1 of Shaft I, Cab M can move down into carpark zone B2 and unload more passengers. After sensors in zone B1 indicate that Cab M has exited zone B1, trailing Cab L can exit ground floor zone 1 and move down into carpark zone B1 and unload more passengers. After sensors in zone 1 indicate that Cab L has exited zone 1, trailing Cab K can move down into zone 20 and service passengers in the lower section of Shaft I. When trailing Cab K enters zone 1, Cab K can stop and unload passengers on the ground floor. After sensors in zone 21 indicate that Cab K has exited zone 21, trailing Cab J can move down into zone 41 and service passengers in the lower middle section of Shaft I.

Step 18. After leading Cab M has unloaded passengers in carpark zone B2, Cab M can move down into carpark zone B3 where it can stop, and unload and load passengers. After sensors in zone B2 indicate that Cab M has exited zone B2, trailing Cab L can move down into carpark zone B2, where it can stop, and unload and load passengers. After sensors in zone B1 indicate that Cab L has exited zone B1, trailing Cab K can move out of zone 1 and down into carpark zone B1 where it can stop and unload and load passengers. After sensors in zone 1 indicate that Cab K has exited zone 1, trailing Cab J can move down into zone 20 and service passengers in the lower section of Shaft I. When trailing Cab J enters zone 1, Cab J can stop and unload all down passengers. Cab J (the new leading cab) can then load new up passengers, and wait to start the next cycle of sequential steps.

Step 19. At this approximate point in time, Cabs F, G, H, and I in Shaft II can begin to execute the aforementioned steps 16 through 18 in Shaft II of a high-rise structure; Cabs B, C, D, and E in Shaft III can begin to execute the aforementioned Steps 11 through 15 in Shaft III of a high-rise structure; Cabs A, Λ, Π, and Ω in Shaft IV can begin to execute the aforementioned steps 6 through 9 in Shaft IV of a high-rise structure; and Cabs J, K, L, and M in Shaft I can begin to execute the aforementioned steps 1 through 4 in Shaft I again. So the previous cycle of sequential steps repeats itself in the four shafts of a high-rise structure, and continues to repeat itself until the computer terminates such cycles, or they are terminated by a human attendant.

Thus, when elevator cabs in Shaft I, Shaft II, Shaft III and Shaft IV in a high-rise structure all operate together in sequence, their traffic patterns become circular. There are always elevator cabs moving up shafts in sequence, while other elevator cabs in other shafts are moving down in sequence. Therefore no passenger in a high-rise structure must wait very long to be serviced by an elevator cab moving up or down.

Figure 5:
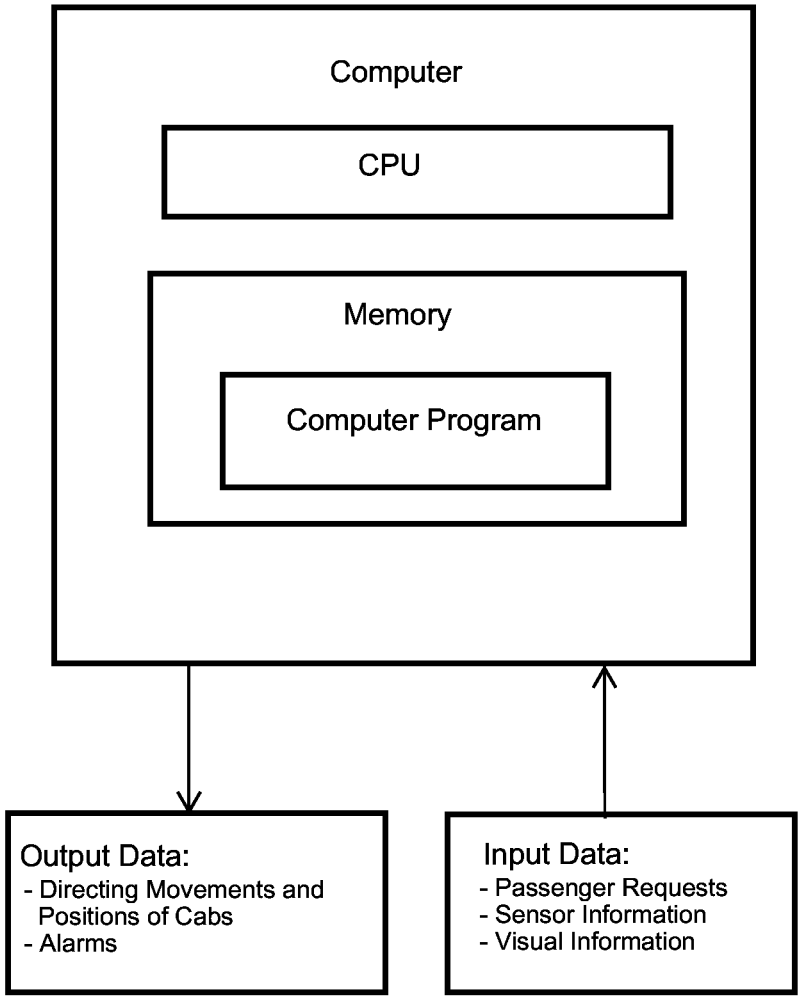
FIG. 5 illustrates a computer for controlling multiple elevator cabs in an elevator shaft, according to one embodiment of the present invention.

FIG. 5 illustrates a computer with a processor, a memory, and a computer program stored on the memory, where the computer may detect input data and direct output data, for controlling multiple elevator cabs according to one embodiment of the present invention. Each computer program of zones and sections for each elevator shaft can vary and be flexible. This can mean that zones and sections in each shaft can be changed to adapt to changing passenger traffic throughout each different 24 hour day and each different seven day week. For example, during the morning rush hours on a normal work day, one or more shafts may be programmed for passengers entering into a building, where each cab in a shaft can express from a designated lower floor up to a designated upper floor, then service a group of upper floors in that particular section of the shaft, and then express back down the shaft to a lower floor to load more passengers. After rush hours, the zones and sections in certain elevator shafts may be changed to accommodate more balanced normal up and down passenger traffic until lunch hours. During lunch hours, the zones and sections in certain shafts may be changed to accommodate different passenger traffic, and then change again after the lunch hours end. Thereafter, in order to accommodate late afternoon passengers who desire to exit the building, one or more shafts may be programmed for an exiting 'express mode,' where each elevator cab can service a group of upper floors and then express down the elevator shaft to the ground floor (or parking floors) where passengers can exit the building, and then expresses back up to a designated group of floors to load other passengers who desire to exit the building. Similarly, between 7 p.m. and 7 a.m. one or more elevator shafts may change its computer control program to 'sleep mode,' where only one or two cabs in one shaft operate in a building during the late evening and early morning hours. On weekends and holidays, a different computer program of zones and sections may be operated in a building or structure.

This new elevator control system and method is at least as failsafe as any current elevator computer control system. The primary reason for this conclusion is that, unless or until one or more sensors positioned in a zone all independently indicate that such zone is empty, no trailing elevator cab can move into that zone. Therefore, no cabs in a multi-cab elevator shaft, whether leading cabs or trailing cabs, can ever have an opportunity to collide with each other.

This control system is also not limited to vertical transportation, such as elevators. For example, it can be applied to control angular transportation such as a 45° degree inclined funicular railway containing multiple independently moving cabs. It can also be applied to horizontally moving cars or pods traveling independently along horizontal rails, or on a road, such as a group of driverless cars following each other through multiple zones. There may also be other applications for this control system, such as deep mines.

Throughout the description and drawings, example embodiments are given with reference to specific configurations. It will be appreciated by those of ordinary skill in the art that the present invention can be embodied in other specific forms. Those of ordinary skill in the art would be able to practice such other embodiments without undue experimentation. The scope of the present invention, for the purpose of the present patent document, is not limited merely to the specific example embodiments or alternatives of the foregoing description.

What is claimed is:

1. An elevator system for controlling two or more elevator cabs operating in an elevator shaft of a structure, the elevator system comprising:

at least one elevator shaft having a plurality of zones, each zone representing at least one floor of the structure;

one or more zones of the plurality of zones having at least one sensor;

at least two elevator cabs moveable within said at least one elevator shaft and each cab moveable independently of other cabs, wherein a first cab preceding any other cab is designated a leading cab, and each cab following the leading cab is designated a trailing cab;

wherein each of the cabs is moveable in a same direction of travel to service zones until each cab has reached its designated end zone;

at least one video camera or other viewing device positioned on a top and on a bottom of each cab for viewing other adjacent cabs; and a controller that determines movement of each elevator cab into a zone wherein the controller only instructs a trailing cab to move into a zone with a sensor, hereinafter referred to as the subject zone, after the sensor in said subject zone detects that a cab that was located in such subject zone has exited that subject zone, and indicates said detection to the controller.

2. The elevator system according to claim 1, wherein only after each cab moving in a direction has reached its end zone do cabs in that shaft begin moving in an opposite direction of travel.

3. The elevator system of claim 1, comprising a plurality of elevator shafts, each elevator shaft comprising a plurality of elevator cabs.

4. The elevator system according to claim 1, wherein the at least one elevator shaft having at least two sections, each section comprising a plurality of zones.

5. The elevator system according to claim 1, wherein an end zone for the leading cab is a last zone of the shaft in each direction of the shaft, and wherein an end zone of each succeeding trailing cab is a zone immediately before the end zone of each preceding cab in each direction of the shaft.

6. The elevator system according to claim 1, wherein each cab comprises at least one sensor on a top and on a bottom of each cab for detecting a distance between cabs and a speed of an immediately trailing cab or leading cab, and that a next zone for a cab to enter in the shaft is empty.

7. The elevator system according to claim 1, further having at least two sensors for each of the one or more zones in the shaft.

8. The elevator system according to claim 4, wherein the at least two sections comprise at least a first section and at least a second section, the at least first section beginning at a first zone, and the at least second section beginning at a plurality of zones after said first zone;

a) wherein a leading cab services zones in the first section, and each trailing cab services one or more zones before the first section;

b) wherein when a leading cab exits any section, an immediately succeeding trailing cab can move into such exited section;

wherein process steps a) and b) continue for any other sections of the shaft, until all cabs are positioned in their respective end zones.

9. The elevator system according to claim 8, wherein the first zone represents a ground floor of the structure.

10. The elevator system according to claim 8, comprising a plurality of zones located before the first section.

11. The elevator system according to claim 8, comprising a plurality of zones located after the first section.

12. The elevator system according to claim 8, comprising a plurality of zones located after the second section.

13. The elevator system according to claim 8, comprising a plurality of zones and sections located after the second section.

14. The elevator system according to claim 1, comprising at least a first elevator shaft and at least a second elevator shaft, wherein at least a first set of cabs services each elevator shaft.

15. The elevator system of claim 14, wherein every cab in a first set of cabs servicing zones in the first elevator shaft can move in one direction of travel, and every cab in another set of cabs servicing zones in the at least second elevator shaft can move in a different direction of travel.

16. A computer-implemented method for controlling multiple elevator cabs in at least one elevator shaft of a structure wherein each cab is moveable independently of the other cabs, the computer comprising a processor, a memory operatively coupled to the processor, the memory storing code executed by the processor for implementing the method comprising:

detecting a passenger request from a desired zone and in a desired first direction of movement, where a zone represents at least one floor of the structure;

directing at least one cab of a set of multiple elevator cabs to begin moving toward a desired zone, all other cabs of the set of multiple elevator cabs are programmed to remain stationary or move in the same first direction of movement as the at least one cab;

directing the at least one cab to service passengers from a desired zone along a first direction of movement until reaching an end zone;

directing at least a second cab of the set of multiple elevator cabs to service passengers from a desired zone along the same first direction of movement of the at least one cab until reaching at least a second end zone;

directing at least one cab of the set of multiple cabs to initiate travel in an opposite direction of movement to the first direction, only after each of all of the multiple cabs have reached its designated end zone; and receiving visual information from at least one video camera or other viewing device of at least one cab of a set of multiple elevator cabs indicating the position of an immediately trailing cab or leading cab.

17. The method according to claim 16, wherein the structure further comprises at least a second elevator shaft comprising at least two or more elevator cabs, the method further comprising:

directing multiple cabs in the at least second elevator shaft to move in a direction opposite to a direction of movement of the multiple cabs in the first elevator shaft, such that multiple cabs in the second elevator shaft will move in the opposite direction of movement as multiple cabs in the first elevator shaft.

18. The method according to claim 16, further comprising: directing at least a first cab to service passengers at one or more intermediary zones before reaching the end zone for the at least first cab.

19. The method according to claim 16, further comprising: directing the at least second cab to service passengers at one or more intermediary zones before reaching the second end zone for the at least second cab.

20. The method according to claim 16, wherein the structure further comprises at least a first section and a second section, each section representing a plurality of zones, the first section beginning at a first zone, the at least second section beginning at a plurality of zones after the first zone, the method further comprising: directing a first cab to service zones in the first section, and directing at least a second cab that is succeeding the first cab to service a zone before the first zone;

directing the first cab to exit the first zone and service the second section, then directing the second cab to move into the first zone;

directing the first cab to move into an end zone of the shaft located after the second section and after the first cab completes servicing the second section, and directing the second cab to begin servicing the second section.

21. The method according to claim 16, further comprising receiving sensor information from a sensor of a desired zone indicating the desired zone is empty and wherein directing movement of any cab into the desired zone is completed only after determining the desired zone is available.

22. A computer program product stored on a non-transitory computer readable medium having instructions recorded thereon, that when executed by one or more processors, cause the one or more processors to:

detect a passenger request from a desired zone and in a desired first direction of movement, where a zone represents at least one floor in at least one elevator shaft of a structure;

direct at least one cab of a set of multiple elevator cabs in the at least one elevator shaft to begin moving toward the desired zone, all other cabs of the set of multiple elevator cabs are programmed to remain stationary or move in the same first direction of movement as the at least one cab, each cab moveable independently of the other cab;

direct the at least one cab to service passengers from the desired zone along the first direction of movement until reaching an end zone;

direct at least a second cab of the set of multiple cabs to service passengers from a desired zone along the same first direction of movement of the at least one cab until reaching a second end zone; and direct at least one of the set of multiple cabs to initiate travel in an opposite direction of movement to the first direction, only after each of all of the multiple cabs have reached its designated end zone;

receive visual information from at least one video camera or other viewing device positioned on a top and on a bottom of each cab for viewing other adjacent cabs.

* * * * *